United States Patent [19]

Sisco

[11] 4,193,191

[45] Mar. 18, 1980

[54] TURRET PUNCH

[76] Inventor: John J. Sisco, 11354 Evans Trail, Beltsville, Md. 20705

[21] Appl. No.: 921,804

[22] Filed: Jul. 3, 1978

[51] Int. Cl.[2] ..... B26F 1/00

[52] U.S. Cl. ..... 30/364

[58] Field of Search ..... 30/364

[56] References Cited

U.S. PATENT DOCUMENTS

| | | | |
|---|---|---|---|
| 314,241 | 3/1885 | Hayes | 30/364 |
| 484,891 | 10/1892 | Fairfield | 30/364 |
| 734,157 | 7/1903 | Bernard | 30/364 |
| 1,308,272 | 7/1919 | Berglund | 30/364 |

*Primary Examiner*—Othell M. Simpson
*Assistant Examiner*—J. T. Zatarga
*Attorney, Agent, or Firm*—Frank P. Cyr

[57] ABSTRACT

A turret-type hand punch adapted primarily for punching holes in leather, imitation leather, or other plastic material. Means are provided on the punch to receive the cut portions of the leather or the like and to retain the same therein during the punching operation so as to prevent the littering of the area where the punching is taking place, with the punched out pieces of leather and the like.

5 Claims, 5 Drawing Figures

FIG. 1
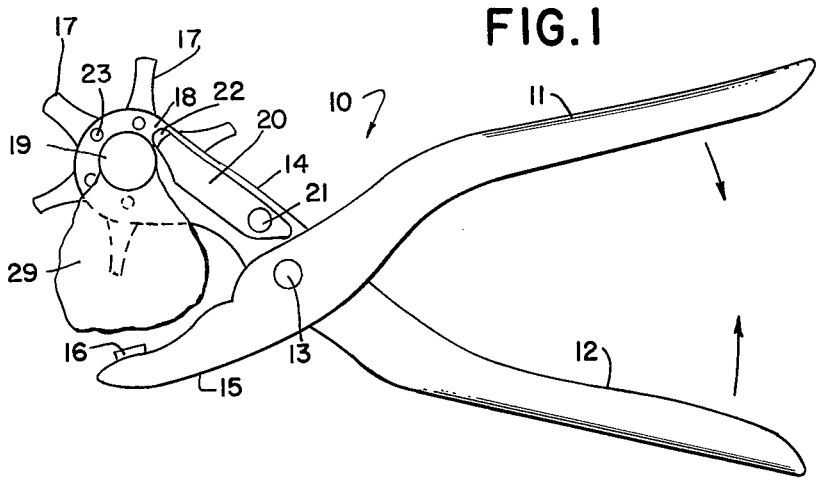
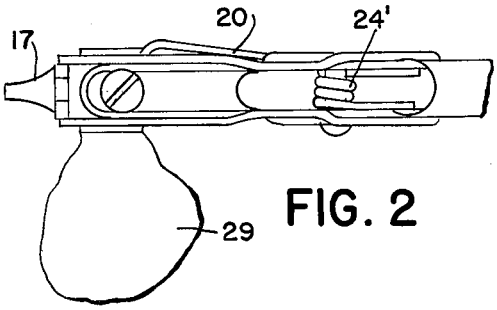
FIG. 2
FIG. 5
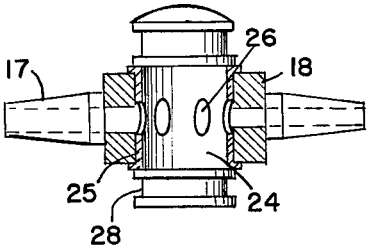
FIG. 3
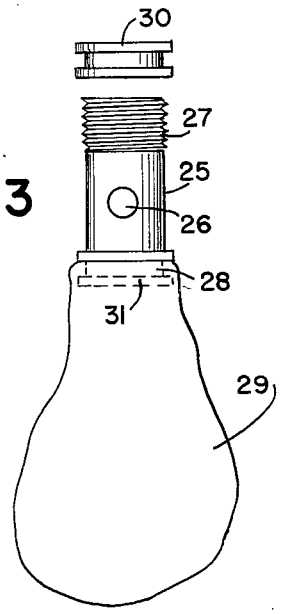
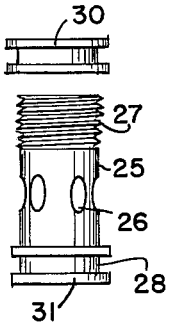
FIG. 4

TURRET PUNCH

BACKGROUND OF THE INVENTION

Hand manipulated turret-type punches have been in existence for many years past. Such punch tool is usually provided with a number of cutting tubes differing in internal diameters so that the user of the punch may select whatever punch size he desires to use and by rotating the turret upon which the tubes are located, he can then align the selected tube with a base or anvil and when the tool is manipulated as by applying a force on the handle arms of the tool, a hole or other opening is formed in the material which has been placed between the base or anvil and the tube selected from the turret. In all previous hand type turret punch tools adapted to perform in the aforesaid manner, no provision has been made to receive the portions of the materials so cut and as a result, these cut portions are usually found on the floor in the area where the punching operation takes place.

With the above in mind, it is one of the primary objects of the invention to provide a means which is detachably secured to the hand punch whereby the cut portions of the leather or like material will be received therein so as to prevent the spilling of such cut portions on the floor in the area where the punching operation is taking place.

Another object of the invention is to provide an expandable receptacle wherein the cut-out portions of the material being punched will be received therein so as to avoid letting the cut portions fall on the floor, etc.

Another object of the invention is to provide a sleeve having an opening formed therein within which the cut portions of the material will exit and thereafter fall into a receptacle secured to the said sleeve.

Another object of the invention is to provide a plurality of openings in a sleeve and wherein said openings will be in registry with the hollow punch members on the turret so that as the punch punches out the material from a sheet being punched, the cut portions will feed into the sleeve and then into a receptacle secured to said sleeve.

Other objects and advantages will become more apparent as the inventive features of the turret punch is described in detail hereinbelow.

DESCRIPTION OF THE DRAWINGS

FIG. 1 is a side elevation of a turret type punch embodying the features of the present invention, FIG. 2 is a sectional view with parts broken away disclosing the turret end portion of the punch, FIG. 3 is a side elevation of the sleeve of the punch showing the receptacle secured thereto, FIG. 4 is a side elevation showing the sleeve provided with a plurality of openings formed therein, and, FIG. 5 is enlarged sectional view showing the manner in which the sleeve is fixed to the turret portion of the punch.

DESCRIPTION OF THE PREFERRED EMBODIMENTS

The invention relates to a hand punch having a rotatable head having a plural number of cutting tubes mounted thereon. Each tube is of a different size so that different size openings may be made in leather, imitation leather, plastic, paper or the like.

Referring now to the drawings wherein like reference numeral designate like parts throughout the several views in the drawing, 10 designates generally a hand type turret punch embodying the improvement of the present invention. The punch includes a pair of hand levers 11, 12 formed of sheet metal or the like and the same are pivotally mounted to one another as by a pivot or bearing 13. Formed at the end of each hand lever 11, 12 are a pair of jaws 14, 15 and mounted on jaw 15 is a block or anvil 16. The turret 18 is mounted for rotation on jaw 14 on a bearing 19 extending through the turret and a spring plate 20 is secured at one end thereof as by a rivet or the like 21, to the jaw 14. The opposite end of the spring plate is provided with a projection 22 which enters into depressions 23 formed in the side of the turret 18. The depressions 23 are so arranged along the side of the turret so that when one turns the turret to select the tube to form the perforation in the material being worked on, the projection 22 will enter into one of the said depressions to retain the turret and tube mounted thereon in proper position so that when the punch is actuated as by applying a force on the hand lever as indicated by the arrows in FIG. 1 of the drawings, the selected tube will engage with the material to be punched and force the same against the anvil or block and eventually punch out the material from therein. A spring 24' is coiled about the bearing 13 to normally force the levers 11, 12 into their separated position such as shown in FIG. 1 of the drawings.

The structure of the punch thus far described is more or less conventional and no claim is made as to novelty of the structure previously described.

As can be appreciated, when one employs the punch to punch out a hole in the material being worked upon, whether it is leather, plastic, or the like, the punched out portion of the material will enter into the tube and upon successive punching operations, the tube becomes filled and ultimately the cut portions of the material will enter into the cavity 24 and unless some means is provided for receiving these cut portions from the aforesaid cavity, the same will end up on the floor or other surface where the punching operation is taking place. This is very undesirable and the crux of the present invention is to remedy this situation.

Referring now more particularly to FIGS. 3, 4 and 5 of the drawings, there is shown therein a sleeve-like member 25 constructed of any suitable material and the sleeve 25 is provided with one or more openings 26 formed in the body of the sleeve. The sleeve fits within the bearing 19 and is rotatable therein for a purpose to be described more fully hereinafter. One end of the sleeve is externally threaded as at 27 and the opposite end thereof is provided with a channel-like member 28 which is employed for securing a receptacle 29 to the said sleeve.

Referring now more particularly to FIG. 3 of the drawings, the sleeve 25 shown therein has but a single opening 26 formed therein. As stated previously, the sleeve is rotatable within bearing 19 and when one wishes to use the punch he removes the closure member 30 by unscrewing the same from the sleeve and then aligns the opening with the tube which is to be employed to punch out the material. Following alignment of the opening 26 in the sleeve 25 with the tube on the turret 18 the closure 30 is thereafter re-threaded on the sleeve and tightened thereon forcing the cap against the side of the turret thereby retaining the sleeve in proper position within the bearing 19. Of course, the bearing 19 will be provided with as many openings therein as there are tubes on the turret so that when the sleeve is rotated within the bearing so as to align the same with one of the said tubes, there will be an opening extending from the inner end of the tube and into the interior of the sleeve 25. If desired, the sleeve such as shown in FIG. 4 of the drawings may be provided with a plurality of openings 26 and the sleeve may also be rotated within the bearing 19 by following the procedure set forth with respect to FIG. 3 of the drawings.

As an alternative to having the sleeve rotatably mounted within the bearing 19, the same may be stationarily mounted within the turret. This alternative form is shown in FIG. 5 of the drawings. The sleeve shown in this form of the invention will be provided with as many openings 26 therein as the numbers of tubes 17 on the turret 18. The sleeve 25 may be press-fitted within the turret. Of course, the openings 26 will have been previously aligned with the openings in the tubes so that when the sleeve is thus press-fitted within the turret the inner end of the tubes will be in alignment with the said openings 26.

As stated previously, one of the main objects of the present invention is to provide a means whereby the cut portions of the material being punched will not escape and drop on the floor or the like. This is accomplished by detachably securing a receptacle to the open end 31 of the sleeve 25. The receptacle may be in the nature of a rubber balloon or similar structure. The neck portion of the receptacle engages within the channel 28 and is held on the punch to receive the cut portions from the punch. From time to time, the receptacle is emptied and then replaced on the punch to again receive the cut portions of the material being punched.

Having now described my invention, which may vary somewhat in it's details without departing from the spirit thereof, what I claim and desire to secure by patent is defined in the following claims:

1. In a turret type punch having a pair of pivoted handles with jaws mounted at one end of said handles and wherein there is provided a rotatable turret on one of said jaws, said turret having a plurality of open ended cutting tubes mounted thereon and wherein an anvil is provided on the other of said jaws against which one end of the cutting tubes will contact upon forcing the handles to a position wherein said one end of said cutting tubes will be forced against said anvil to form an opening in a material placed between said tube and said anvil, the improvement comprising, an opening formed centrally of said jaw having said rotatable turret with said tubes mounted thereon, the interior of said tubes communicating with said opening, a sleeve mounted within said opening, said sleeve having an opening therein aligned with one of the said tubes, a channel formed on one end of said sleeve, a receptacle detachably secured to said channel, the cut portion of the said material passing through said tubes and entering into said sleeve and ultimately into said receptacle.

2. The structure recited in claim 1 wherein said receptacle is a rubber balloon.

3. The structure recited in claim 1 wherein said sleeve is fixed to said turret.

4. The structure recited in claim 1 wherein said sleeve is removably mounted on said turret.

5. The structure recited in claim 1 wherein said sleeve is provided with a plurality of openings.

* * * * *